United States Patent [19]

Humphrey

[11] Patent Number: 4,563,863

[45] Date of Patent: Jan. 14, 1986

[54] AUTOMATIC STRETCH WRAPPING MACHINE

[75] Inventor: John R. Humphrey, Naples, Fla.

[73] Assignee: International Packaging Machines, Inc., Naples, Fla.

[21] Appl. No.: 514,048

[22] Filed: Jul. 15, 1983

[51] Int. Cl.[4] ..... B65B 11/04

[52] U.S. Cl. ..... 53/556; 53/587

[58] Field of Search ..... 53/556, 504, 587; 198/502, 781

[56] References Cited

U.S. PATENT DOCUMENTS

| | | | |
|---|---|---|---|
| 3,515,254 | 6/1970 | Gary | 198/502 |
| 3,724,642 | 4/1973 | De Good | 198/781 |
| 4,152,879 | 5/1979 | Shulman | 53/211 X |
| 4,204,377 | 5/1980 | Lancaster | 53/587 X |
| 4,204,593 | 5/1980 | Leach | 198/781 |
| 4,216,640 | 8/1980 | Kaufman | 53/587 X |
| 4,232,501 | 11/1980 | Stackhouse | 53/587 X |
| 4,235,062 | 11/1980 | Lancaster | 53/587 X |
| 4,271,657 | 6/1981 | Lancaster | 53/587 X |
| 4,300,326 | 11/1981 | Stachouse | 53/587 X |
| 4,432,185 | 2/1984 | Geisinger | 53/587 X |

*Primary Examiner*—John Sipos

*Attorney, Agent, or Firm*—Antonelli, Terry & Wands

[57] ABSTRACT

An automatic stretch wrapping machine is disclosed. An automatic stretch wrapper in accordance with the invention includes a turntable having a surface for rotatably supporting a load to be wrapped with a wrapping material; a source of wrapping material of a given width to be used to wrap a load disposed on the turntable; apparatus for gathering the wrapping material into a reduced width; a clamp mounted for rotation with the turntable for clamping the gathered wrapping material disposed in a plane to cause the wrapping material to be wrapped around the load without slippage as it rotates with the turntable, the clamping means not being wrapped with the wrapping material during wrapping of the load; a cutter carried by the turntable disposed between the support surface of the turntable and the clamp for severing gathered wrapping material gripped by the clamp; and a controller for controlling the operation of the wrapping machine to cause the clamp to clamp the gathered wrapping material at the initiation of wrapping of a load and release the gathered wrapping material at a time before the activation of the gathering apparatus, the gathering apparatus to be activated after the release of the gathered wrapping material from the clamp to reduce the width of the wrapping material, the clamp to be activated after the wrapping material is gathered to grip the gathered wrapping material, and the cutter to be activated to sever the clamped gathered material.

33 Claims, 14 Drawing Figures

10
12
14
16
18
20
22
24
30
32
34
36
37
38
39
40
41
42
43
44
50
52
54
56
58
59
60
62
64
65
66
68
71
72
73
74
76
77
79
80
90
94
98
100
102
104
108
110
111
112

AUTOMATIC STRETCH WRAPPING MACHINE

BACKGROUND AND SUMMARY OF THE INVENTION

1. Field of the Invention

The present invention relates to machines for automatically unitizing a plurality of associated articles by wrapping with a stretchable plastic wrapping material.

2. DESCRIPTION OF THE PRIOR ART

Automatic stretch wrapping machines unitize a group of associated objects, such as individual boxes stacked on a pallet, by wrapping with a stretchable plastic wrapping material under tension. U.S. Pat. Nos. 4,077,179, 4,216,640, 4,235,062, 4,271,657, 4,300,326 and 4,302,920 disclose stretch wrapping machines which wrap a load with multiple layers of stretchable plastic wrapping material under tension.

The stretch wrapping machine disclosed in U.S. Pat. No. 4,077,179 has a pair of clamps which are mounted on a turntable which rotatably supports the load to be wrapped. Clamps grip the wrapping material for approximately 1 and ¼ turns of the turntable before being withdrawn below the plane of the turntable. The wrapping material wraps against the outside of the clamps prior to their withdrawal which prevents maximum wrapping tension from being applied prior to clamp withdrawal, is wasteful of wrapping material and can result in a loose wrapping of the load when the clamp is retracted. The clamps grip a single thickness of the wrapping material across its width. Clamping of a stretch wrapping material by gripping a single thickness can cause tearing or severance of the film when high wrapping tension is used. Morever, withdrawal of film clamping clamps while the turntable is on the "fly" complicates turntable design. The wrapping material is severed by a combination clamp-cutting mechanism which severs the wrapping material across its full width when a pair of arms carrying the clamp-cutting mechanism are pivoted into vertical engagement with the wrapping material. The uniform vertical cutting of the wrapping material across the full width of the wrapping material is difficult to achieve. A non-uniform edge can make it difficult to attach the trailing edge of the severed wrapping material to the load. Vertical cutting mechanisms are also service prone and expensive. The severed wrapping material is brushed against the load by a brush to attach the trailing end of the wrapping material to the load.

U.S. Pat. No. 4,216,640 discloses an automatic stretch wrapping machine which clamps the leading edge of the stretch wrapping material with a pair of rotatable clamps which swing above the plane of the table to grasp the stretch wrapping material but pivot below the table during the initial wrapping of the load to eliminate the wrapping of the stretch wrapping material around the outside of the clamps. Thereafter, at the end of the wrapping cycle the stretch wrapping material is severed by the rotation of the clamps in the opposite direction to cause cutting surfaces which are mounted on the opposite side of the clamping arms to shear the stretch wrapping material. Thus, the clamping and shearing functions are performed by a single pair of rotatable arms which are initially rotated to grasp the stretch wrapping material and rotate it to a position below the surface of the turntable and thereafter after release of the leading edge of the wrapping material, the arms are rotated in such a direction that the cutting edges engage the stretch wrapping material at the end of the wrapping cycle to sever it.

U.S. Pat. No. 4,235,062 discloses a stretch wrapping machine utilizing wrapping material of reduced width to form a unitized load with breathing capability. The stretch wrapping material is reduced in width by a roping mechanism. The turntable clamps grab the leading edge of the wrapping material at a position above the turntable. The turntable clamping assembly is identical to that described in U.S. Pat. No. 4,077,179. The trailing end of the stretch wrapping material is tucked underneath a wrap of the stretch wrapping material which encircles the load and the outside of the turntable clamps. The turntable clamps are then pivoted to a position below the turntable surface which causes the wrap of stretch wrapping material which has been held away from the load to snap back toward the load and capture the end which has been tucked underneath it between the load surface and the clamps. Thereafter, the turntable clamps move upward and engage the new leading edge of the stretch wrapping material which is held in the clamps of the shearing mechanism.

U.S. Pat. No. 4,271,657 discloses an automatic stretch wrapping machine in which the leading and trailing edges of the stretch wrapping material are formed into ropes to facilitate their attachment together by a ring type of closure. The leading end of the stretchable wrapping material is secured by a clamping mechanism during the rotation of the turntable. A gathering arm is pivoted toward the clamp mechanism to overlay the trailing edge of the wrapping material, which has been formed into a rope, in proximity to the clamped leading edge of the wrapping material which is also in the form of a rope. The leading and trailing end sections of the wrapping material are tied together in a ring. Upon tying, the clamp is opened to release the leading edge of the wrapping material. Thereafter, the clamp is closed to hold the trailing rope section in a position upstream from a cutting mechanism which is disposed adjacent to the load. The cutting mechanism is activated to sever the trailing end of the rope section. The gathering arm is then rotated back to its original position and the wrapped load is transported away from the turntable. The clamped trailing end rope section becomes the leading end rope section of the next wrapping operation.

U.S. Pat. No. 4,300,326 discloses an automatic stretch wrapping machine which utilizes a clamping mechanism that is disposed below the surface of the turntable. The leading end of the wrapping material is grasped in the clamp mechanism. The trailing end of the wrapping material is formed into a rope-like configuration which is positioned adjacent the leading end by an actuator. The leading and trailing ends are tied together. The clamp mechanism then releases the leading end of the wrapping material and clamps the trailing end of the wrapping material at a point upstream from the point where the wrapping material is severed by the cutting mechanism.

U.S. Pat. No. 4,302,920 discloses an apparatus for wrapping a load with a stretchable plastic wrapping material. The patent discloses the prestretching of the wrapping material to produce an elongation which resists stresses during wrapping which could tear the film. It is preferred that the degree of elongation is at least 50% to avoid web breakage. A roping mechanism is disclosed.

U.S. Pat. No. 4,204,377 discloses a process for automatically spiral wrapping a unitary package with a netting material. The apparatus is similar to that disclosed in U.S. Pat. No. 4,235,062.

SUMMARY OF THE INVENTION

The present invention is an automatic wrapping machine which uses stretchable wrapping material for securing a load having a plurality of articles into to a unitary package without complicated wrapping, clamping and shearing structures. In its preferred form, the invention is part of a system which has a conveyor which coordinates the feeding of loads from an infeed conveyor section to a wrapping position on a turntable by a turntable conveyor section where the packages are automatically wrapped with a stretchable wrapping material and thereafter are conveyed to a discharge conveyor section where the loads are transported away from the turntable without operator intervention. However, the invention may be practiced without a conveyor to place the load on the turntable. In this mode the operator activates a remote start or other suitable control.

The invention has many advantages. The invention minimizes loose "tails" which are caused by the incomplete coverage of the leading edge of the wrapping material by subsequent layers of wrapping material. Loose tails can interfere with the movement of stacked wrapped loads where they are pinned between other stacked adjacent loads and do not contribute to the effectiveness of the wrapping in containing the load. The location of the clamping and cutting mechanisms on one end of the turntable minimizes or eliminates "tails". The clamping of the gathered wrapping material permits the application of full wrapping tension from the beginning of wrapping which minimizes the amount of stretch wrapping material required for wrapping and eliminates tearing of the wrapping material which can be a problem with clamps in stretch wrapping machines which grip the entire width of the wrapping material. The centering apparatus of the invention permits loads which are as large as the turntable to be wrapped without overhang on one edge of the ends of the turntable which could prevent the wrapping operation; prevents large imbalances of the turntable which could interfere with rotation or damage the rotatable support; and minimizes large cyclical swings in the velocity of the wrapping material which could tear the wrapping material in wrapping material supplies which do not supply the wrapping material at constant tension. The location of the clamping mechanism below the wrapping surface of the turntable permits the effective utilization of the first layer of wrapping material for load containment which does not occur in those systems which wrap the initial turns of wrapping material around the outside of the clamping mechanism. The attachment of the trailing end of the wrapping material by brushing it against an underlying layer to which the trailing end clings eliminates complicated tying structures which are found in some prior art machines. The activation of the gathering, cutting, clamping and arm mechanisms after stopping of the turntable simplifies design and eliminates the requirement for air slip rings to power those elements rotated with the turntable.

An automatic wrapping machine in accordance with the invention includes a turntable having a surface for rotatably supporting a load to be wrapped with a wrapping material; a supply of wrapping material which provides wrapping material of a given width to be used to wrap a load disposed on the wrapping surface of the turntable; a motor for rotating the turntable to cause wrapping of loads with the wrapping material under tension to elastically stretch the wrapping material during wrapping; apparatus for gathering the wrapping material into a reduced width; a clamp mounted for rotation with the turntable for clamping the gathered wrapping material to cause the wrapping material to be wrapped around the load without slippage as it rotates with the turntable without the clamp being wrapped with the wrapping material; a cutter carried by the turntable disposed between the surface of the turntable on which the loads rest and the clamp for severing the gathered wrapping material; and a controller for controlling the operation of the wrapping machine to cause the clamp to clamp the gathered wrapping material at the initiation of wrapping of the load to hold the wrapping material under tension to maintain stretch in the wrapping material and to release the gathered wrapping material at a time before the activation of the apparatus for gathering the wrapping material to allow the gathered wrapping material to assume a non-stretched condition, the apparatus for gathering to be activated after the release of the gathered wrapping material from the clamp to reduce the width of the wrapping material, the clamp to be activated after the wrapping material is gathered to clamp the gathered wrapping material, and the cutter to be activated to sever the clamped gathered material.

In the preferred form of the invention, the invention includes apparatus for stopping and locking the turntable in a fixed rotational home position at the completion of wrapping. The controller functions to stop the turntable at the home position at the completion of wrapping by activating of the apparatus for stopping. The clamp is activated to release the gathered wrapping material clamped at the initiation of wrapping after the completion of wrapping.

Further, in accordance with the invention, a pivotable arm, which has a retracted position where the arm does not engage the wrapping material and an extended position where it engages the wrapping material, aligns the wrapping material in a plane intersecting the clamp. The controller causes the arm to extend after the clamp has opened to release the gathered wrapping material which was clamped during the initiation of wrapping. The pivotable arm further includes a brush which engages the wrapping material across its width to force the wrapping material against the load when the arm is in its extended position and smoothly applies the wrapping material to the load.

The invention includes a conveyor for moving loads to be wrapped along its longitudinal axis which has an infeed section located upstream of the turntable, a turntable conveyor section and a discharge section which is located downstream of the turntable. The controller selectively activates the infeed section to move a load to be wrapped from the infeed section onto the turntable, selectively activates the turntable conveyor to move a load coming from the infeed section to a center position on the turntable where the load is to be wrapped, and after wrapping activates the turntable conveyor section to move the load from the position where the load was wrapped on the turntable to the discharge conveyor section, and selectively activates the discharge conveyor section to move a load which has been wrapped along the discharge conveyor section away from the turntable.

The invention further includes apparatus for centering the longitudinal center of the load at the center of the longitudinal axis of the turntable where the load is to be wrapped. The centering apparatus includes a pulse generator, one pulse being produced per unit distance of motion of a load along the longitudinal axis of the infeed and turntable conveyors, a doubler for multiplying the frequency by two of the pulses produced by the pulse generator, a counter responsive to the pulse generator and the doubler, for counting a total of C pulses beginning from the passage of a leading edge of a load past the line of sight of an object detecting photocell, the counter functioning to count the number of pulses produced by the pulse generator during the passage of the leading and trailing edges of a load to be wrapped past the line of sight of the load detecting photocell and after passage of the trailing edge of the object past the line of sight of the photocell functioning to count the pulses produced by the doubler until the total count is equal to C wherein C is a constant which is equal to the number of pulses produced by the pulse generator and doubler during passage of the load past the line of sight of the photocell to the center of the turntable along its longitudinal axis; and apparatus for stopping the activation of the infeed conveyor section when the count of the counter for counting is equal to C.

The conveyor has an infeed-turntable gap which is disposed between the infeed conveyor section and the turntable conveyor section and a turntable-discharge gap which is disposed between the turntable conveyor section and the discharge conveyor section; a first photocell which is disposed in proximity to an end of the infeed conveyor section located closest to the turntable, the first photocell having a line of sight transverse to the longitudinal axis of the conveyor and pointed in a direction angling away from the turntable for producing a first control signal for detecting the presence of a load to be wrapped on the infeed conveyor section; a second photocell which is disposed in proximity to the infeed-turntable gap, the second photocell having a line of sight extending approximately orthogonal to the longitudinal axis of the conveyor across the infeed-turntable gap for producing a second control signal for detecting the presence of a load between the infeed and turntable conveyor sections and the leading and trailing edges of a load to be wrapped; a third photocell which is disposed in proximity to an end of the turntable conveyor section located closest to the infeed conveyor section, the third photocell having a line of sight transverse to the longitudinal axis and pointed in a direction angling toward the turntable for producing a third control signal indicative of the presence of a load on the turntable; a fourth photocell which is disposed in proximity to an end of the discharge conveyor section located closest to the turntable, the fourth photocell having a line of sight approximately orthogonal to the longitudinal axis of the conveyor for producing a fourth control signal indicative of the presence of the load between the discharge conveyor and the turntable conveyor sections; and wherein the controller is responsive to the first control signal for initiating the movement of a load to be wrapped from the infeed conveyor section to the turntable; the second control signal to detect the leading and trailing edges of the load to the wrapped; and the fourth signal for indicating that the load has cleared the turntable.

The apparatus for gathering the wrapping material comprises an element which has a retracted position which does not contact the wrapping material and an extended position in which the element engages the wrapping material in a plane which intersects the clamp to cause the width of the wrapping material to be reduced and the gathered wrapping material to be forced into engagement with the clamp. The apparatus for gathering the wrapping material is preferably pivotable and includes at least one rotatable element which engages an edge of the wrapping material as it is pivoted from its retracted position to its extended position to reduce the width of and gather the wrapping material.

The turntable conveyor section includes a plurality of rotatably mounted rollers having their axes of rotation disposed perpendicular to the longitudinal axis of the conveyor during the operation of the turntable conveyor section; apparatus for driving the rollers which is movable from a retracted position where it does not drive the rollers into an extended position in which the rollers are driven during the longitudinal movement of a load on the turntable; a lock for locking the rollers against rotation when the apparatus for driving the rollers is in its retracted position and released when the apparatus for driving the rollers is in its extended position; and wherein the controller causes the selective movement of the apparatus for driving the rollers from its retracted position to its extended position during the infeed of a load onto the turntable, the centering of the load on the turntable, and the discharge of the load from the turntable.

The turntable conveyor has first and second ends which are respectively located in proximity to the infeed and discharge sections, at least one idler roller being located at each of the first and second ends, each idler roller having two ends and being disposed such that its ends are equidistant from the longitudinal centerline of the conveyor and the length of each idler roller being less than the length of the driven rollers; the infeed and discharge conveyor sections each having at least one pair of idler rollers having a common axis of rotation which is disposed at an end of the conveyor section, the pair of idler rollers of the infeed conveyor section being located in proximity to the turntable conveyor section and the pair of idler rollers of the discharge conveyor section being disposed in proximity to the turntable conveyor section, a gap being disposed between each pair of idler rollers which intersects the longitudinal centerline of the conveyor whereby the turntable may rotate without interference with the infeed and discharge conveyor sections while the longitudinal displacement between the rollers of the turntable and the infeed and discharge sections is minimized.

Preferably the turntable has opposed ends which are intersected by the longitudinal centerline. Each wrapped load has a leading edge of wrapping material which is the wrapping material gripped by the clamp at the initiation of wrapping and is wrapped under tension which elastically elongates the wrapping material extending from the clamped leading edge to the point of first engagement with the load. The clamp and cutter are mounted on the turntable in proximity to one of the ends of the turntable. The turntable is rotated in a direction of rotation such the length of the elastically elongated wrapping material extending between the clamp and the point of first engagement with the load is minimized so that upon release of the initially gathered wrapping material for the clamp, the leading edge is drawn toward the load to reduce any loose section of the leading edge.

Preferably, the wrapping material is stretchable and is prestretched before delivery to the turntable for wrapping a load and is delivered to the turntable under constant tension to avoid tearing of the wrapping material.

Preferably, the turntable supports the load on a wrapping surface and the clamp is located below the wrapping surface so that the wrapping material does not engage the clamp during the wrapping of a load except at the point of clamping.

DESCRIPTION OF THE PREFERRED EMBODIMENTS

Figure 1:
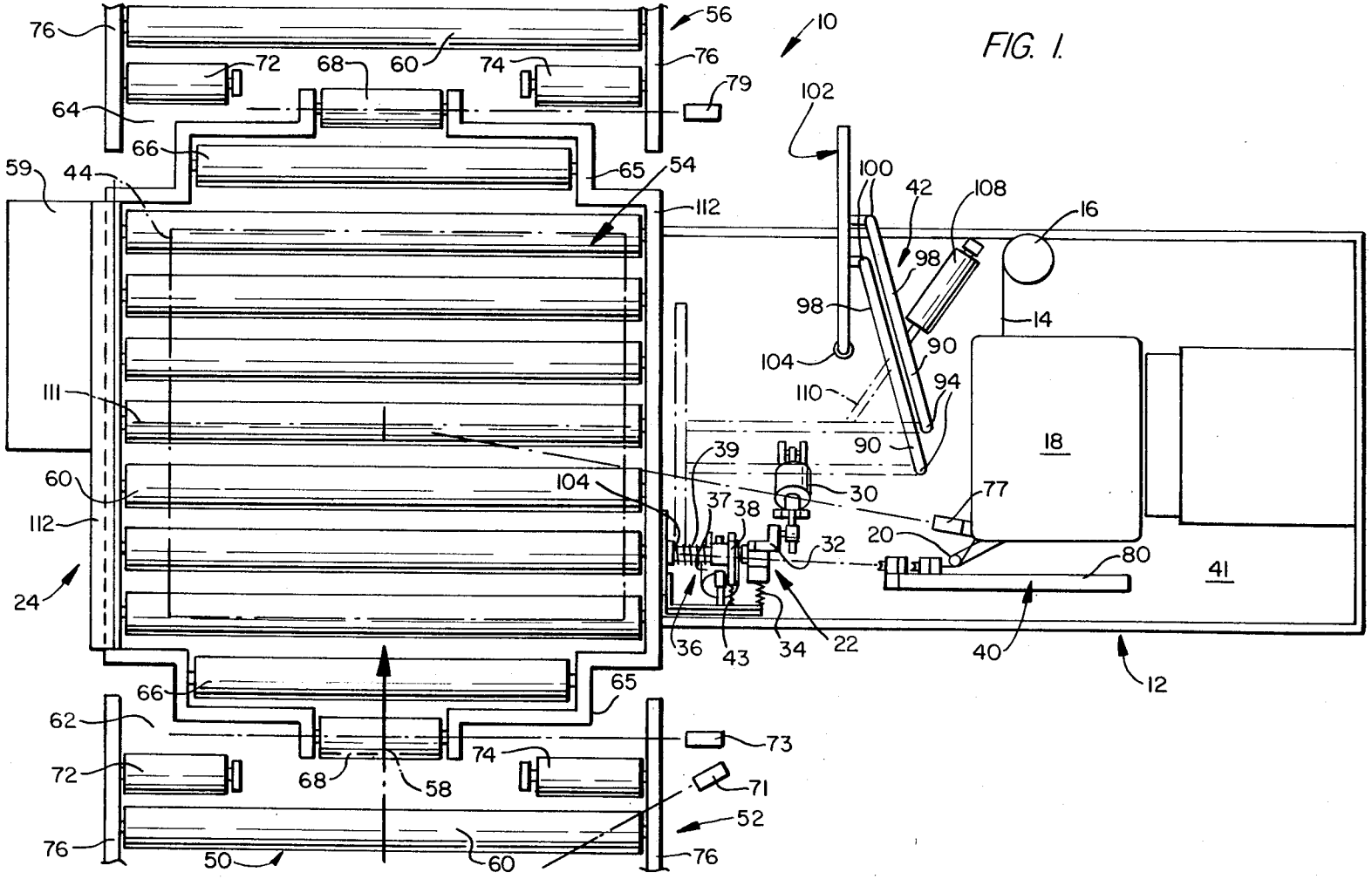
FIG. 1 illustrates a top plan view of the present invention.
Figure 2:
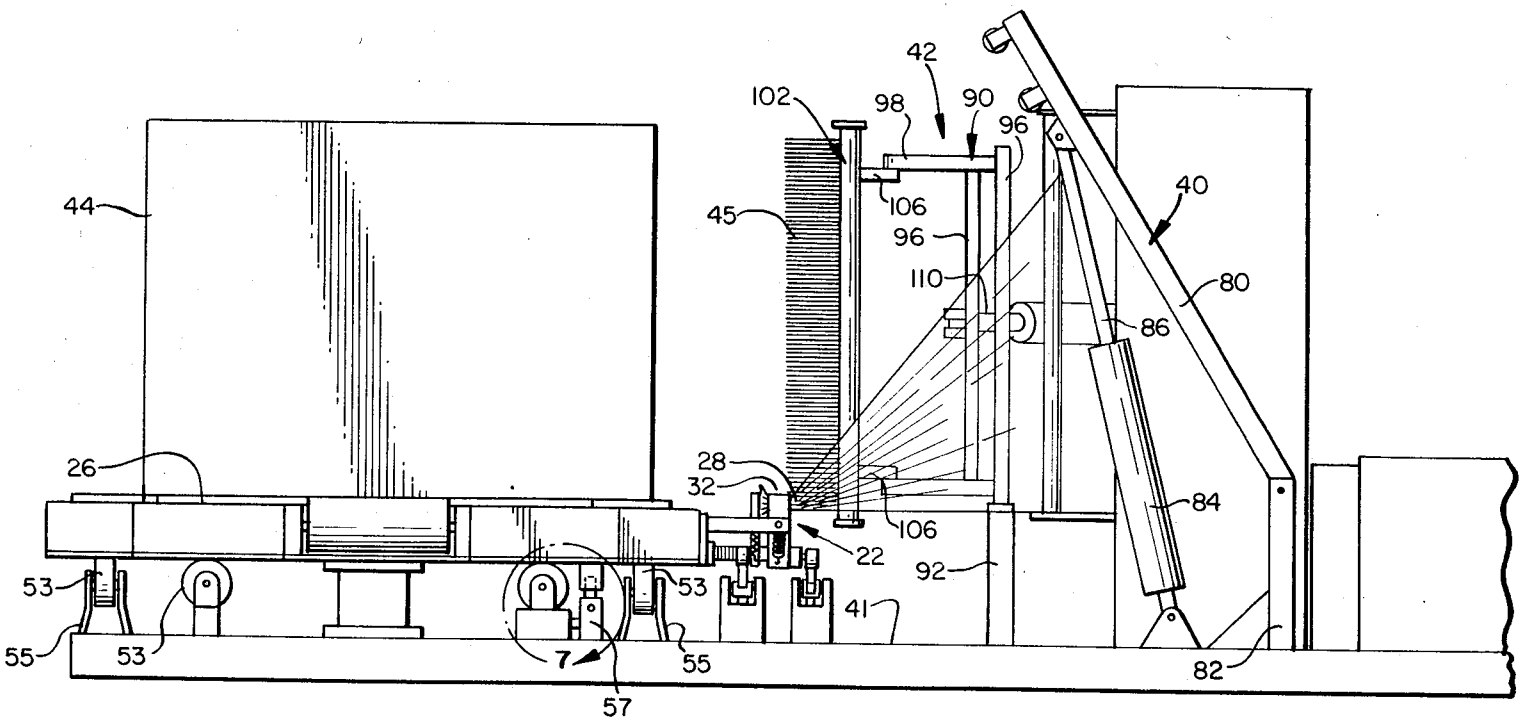
FIG. 2 illustrates an elevational view of the present invention viewed from the infeed conveyor section at the start of wrapping.
Figure 3:
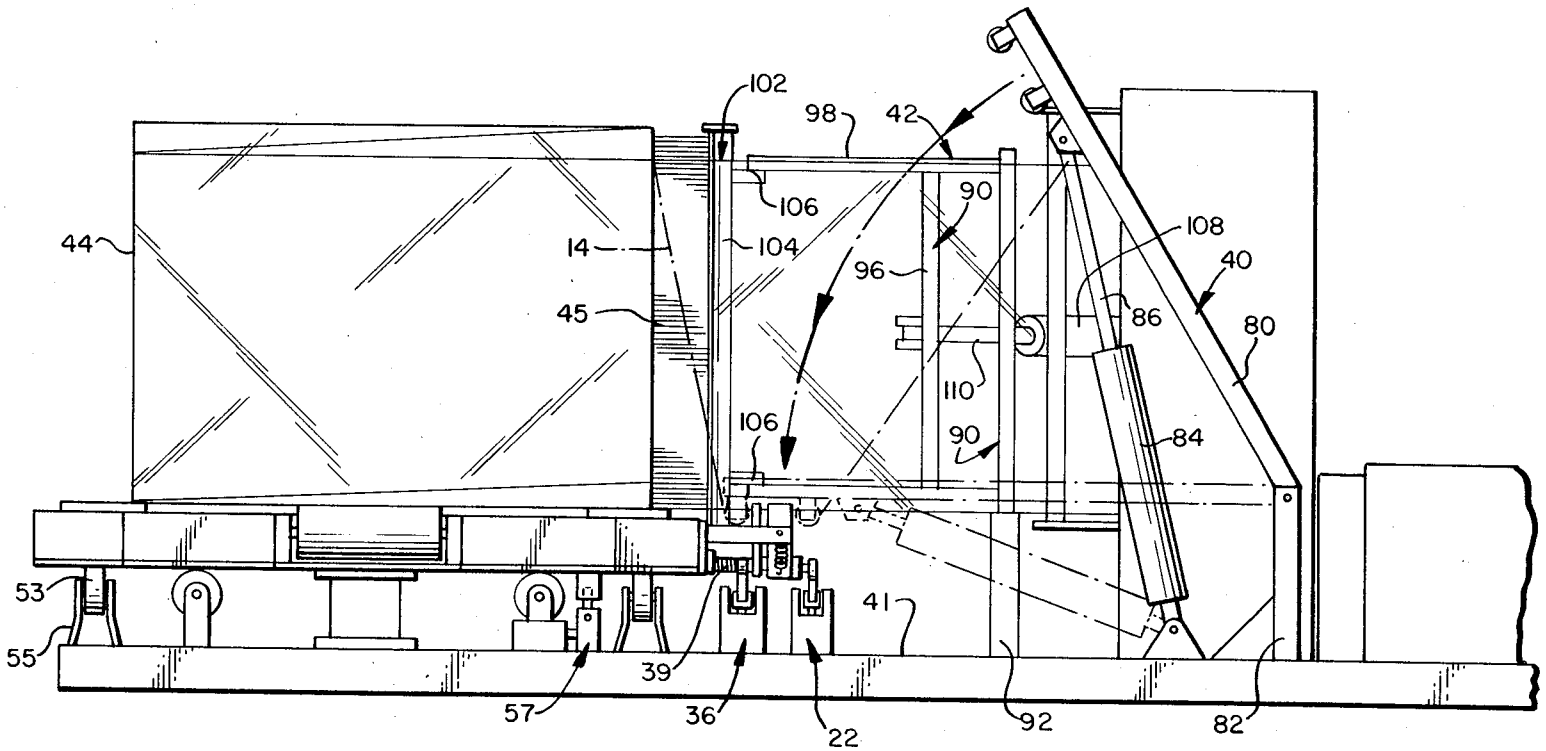
FIG. 3 illustrates an elevational view of the present invention viewed from the infeed conveyor section after the wrapping operation has been completed and the turntable has stopped at its home position.

The major components which are present in the invention are best understood with reference to FIGS. 1–3. The invention 10 is an automatic stretch wrapping machine 12 which functions to apply a stretchable wrapping material 14 from a supply source 16 via a constant tension wrapping material supply and vertically translatable carriage 18. While the invention is not limited to using spiral wrapping produced by the vertically translated carriage, the vertically translatable carriage is used to move the wrapping material along a tower (not illustrated) vertically upward and then downward to form a spiral wrap around the load in accordance with known techniques. The invention may also be practiced by wrapping loads with wrapping material of a width equal to the load height without movement of the wrapping material relative to the load. The constant tension supply and vertical carriage 18 preferably the assignee's UNITENSION system. The preferred form of a constant tension drive and vertical translatable carriage is described in patent application Ser. No. 374,741 filed May 4, 1982 entitled Constant Tension Stretch Wrapping Apparatus and Method which application is incorporated hereby by reference in its entirety. The stretch wrapping material 14 is fed from the constant tension supply and vertical carriage 18 around idler roller 20 to a clamp 22 which is secured to the turntable 24 and is located below the support surface 26 of the turntable. The turntable 24 is rotatably driven by a motor 25 (FIG. 9) to cause wrapping of loads under tension which is sufficient to elastically elongate the wrapping material. The clamping of gathered wrapping material 28 by the clamp 22 permits the application of tension by the motor 25 during the initiation of wrapping of sufficient magnitude to elastically elongate the leading end of the wrapping material extending from the clamp to the point of first contact with a load. Upon opening of the clamp 22 after completion of wrapping, the lead end of the wrapping material assumes a non-stretched state which minimizes or eliminates tails. It should be understood that the clamp 22 does not engage the wrapping material during wrapping except at the point where the jaws 32 of the clamp 22 engage the gathered wrapping material 28. An air cylinder 30 activates the jaws 32 of the clamp 22 which are normally biased open by a spring 34 and are pivoted closed by activation of the air cylinder 30 under the control of a microprocessor controller which is discussed infra. The sequence of the operation of the clamp 22 during wrapping will be described in detail infra. A cutter 36 is disposed downstream from the clamp 22 for severing the gathered wrapping material 28 which is held in the clamp. Air cylinder 37 activates the cutter 36. It should be understood that the moveable cutting element 38 of the cutter 36 is normally biased by an axial spring 39 against a stationary element (not illustrated). A spring 43 biases the moveable cutting element 38 open when the air cylinder 37 is not activated. The operation of the cutter 36 is described in detail infra. The gathering mechanism 40 is pivotally mounted to the base 41 of the stretch wrapper 12 such that it may be pivoted from a vertical retracted orientation to a horizontally disposed extended position which functions to force an edge of the wrapping material 14 into the clamp 22. The operation of the gathering mechanism 40 is discussed in detail infra. A pivotable arm 42 is rotatably secured to the base 41 of the stretch wrapper 12. The pivotable arm 42 is pivoted from a retracted position to an extended position in which it forces the stretch wrapping material 14 into a vertical plane intersecting the opening between the jaws 32 of clamp 22. The positioning of the stretch wrapping material 14 into the vertical plane permits the gathering mechanism 40 in its extended position to force the gathered wrapping material 28 into the clamp 22. A brush 45 is mounted vertically on the pivotable arm 42 for forcing the wrapping material 14 against a load 44 for the purpose of securing the trailing end of the stretch wrapping material 14 after severing by cutter 36 across its entire width to the underlying layer by reliance on the inherent cling of adjacent layers of the wrapping material for each other without requiring complicated mechanical tying structures. The individual loads 44 are transported to and from the turntable 24 by means of a conveyor 50 which has an infeed conveyor section 52, a turntable conveyor section 54 and a discharge conveyor section 56. The loads 44 which are to be stretch wrapped are delivered along the longitudinal centerline (axis) 58 of the conveyor 50 under the control of the microprocessor controller to be described infra. It should be understood that the loads are successively moved from the infeed conveyor section 52 to the turntable conveyor section 54 where stretch wrapping is performed and to the discharge conveyor section 56 where the loads are transported away from the turntable 24.

Each of the conveyor sections 52, 54 and 56 have a plurality of driven rollers 60 which are powered by independent drive units. The turntable conveyor drive unit 59 is described in detail with reference to FIGS. 4 and 5 infra. The operation of the conveyor sections 52, 54 and 56 is controlled by the microprocessor control to be described infra in conjunction with inputs from four photocells which are disposed to observe the passage of a load 44 along the longitudinal centerline 58 of the conveyor 50. An infeed conveyor-turntable gap 62 separates the infeed conveyor section 52 from the turntable 24 by a sufficient distance to permit clearance of the turntable during rotation. Similarly, a discharge conveyor-turntable gap 64 separates the turntable 24 and the discharge conveyor section 56 by a sufficient distance to permit rotation of the turntable. Spaced idler rollers are provided in proximity to the infeed conveyor-turntable gap 62 and discharge conveyor gap 64 to minimize the separation between the turntable conveyor section 54 and the infeed conveyor section 52 and the discharge conveyor section 56. The ends 65 of the turntable conveyor section 54 which are in proximity to the infeed conveyor section 52 and the discharge conveyor section 56 each have a pair of idler rollers 66 and 68 which are axially shorter than the driven rollers 60 and vary in length such that the outermost idle roller 68 is shorter than the inner idler roller 66. The longitudinal centerline 58 intersects the axial midpoint of the rollers 66 and 68.

It should be understood that only a single pair of idler rollers 66 and 68 has been illustrated for the sake of not unduly complicating illustration. Additional idler rollers or a single idler roller could alternatively be used. A pair of idler rollers 72 and 74, which have a common axis of rotation, are rotatably journaled in the frame members 76 of the infeed conveyor section 52 and the discharge feed conveyor section 56. A gap is disposed between the ends of the idler rollers 72 and 74 which intersects the longitudinal centerline 58 of the conveyor 50. The complementary configuration between the idler rollers 72 and 74 of the infeed conveyor section 52 and the discharge conveyor section 56 and the idler rollers 66 and 68 of the turntable 24 minimizes the infeed conveyor gap 62 and the discharge conveyor gap 64.

Figure 8:
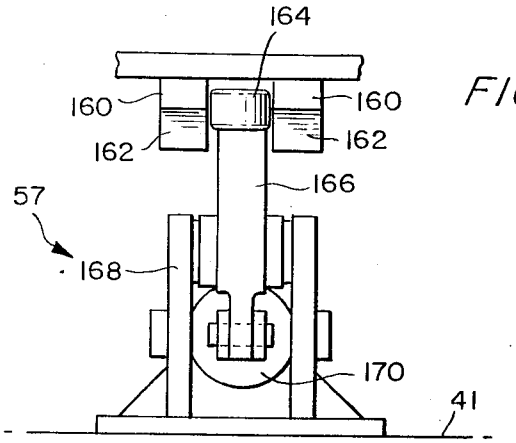
FIG. 8 is an end view of the mechanism for locking the table in a fixed rotational position.
Figure 7:
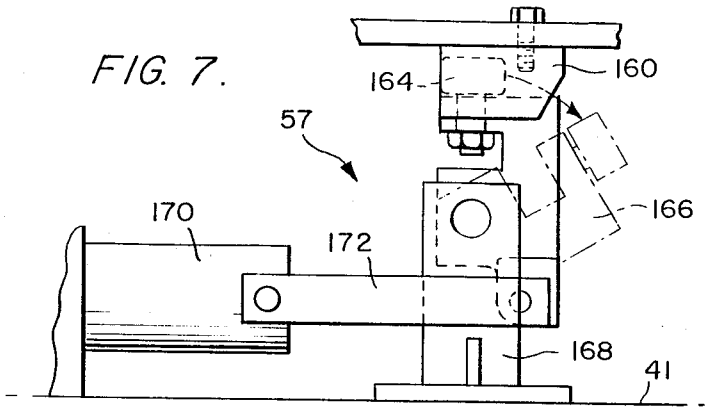
FIG. 7 is a side view of the mechanism for locking the turntable in a fixed rotational position.

Four photocells are provided for detecting the presence of a load 44 at various parts of the conveyor 50 for controlling the automatic sequence of events occurring during the stretch wrapping of the load beginning with the infeed of the load from the infeed conveyor section 40, the positioning of the load at the longitudinal centerline 111 of the turntable which is parallel to the rotational axis of the individual driven rollers 60 of the turntable conveyor section 54, the stretch wrapping of the load on the turntable, the discharge of the load from the turntable and the transportation of the load downstream along the discharge conveyor section 56. The first photocell 71 is disposed in proximity to the boundary of the infeed conveyor section 52 located closest to the turntable 24. The photocell 71 has a line of sight transverse to the longitudinal centerline 58 of the conveyor 50 which is pointed in a direction angling away from the turntable 24 for producing a first control signal which is sensed by the microprocessor for detecting the presence of a load on the infeed conveyor section 52. The second photocell 73 is disposed in proximity to the infeed-conveyor gap 62. The second photocell 73 has a line of sight extending approximately orthogonal to the longitudinal centerline 58 of the conveyor 50 across the infeed conveyor gap 62 for producing a second control signal for detecting the presence of a load 44 between the infeed conveyor section 52 and the turntable conveyor section 54 and the leading and trailing edges of a load. A third photocell 77 is disposed in proximity to the boundary of the turntable conveyor section 54 located closest to the infeed conveyor section 52. The third photocell 77 has a line of sight transverse to the longitudinal centerline 58 which is pointed in a direction angling toward the centerline 111 of the turntable 24 for producing a third control signal indicative of the maximum height of the load 44 (when spiral wrapping is used) and the presence of a load on the turntable. For spiral wrapping the third photocell 77 is mounted on the vertical carriage 18 to permit it to detect the maximum height of the load 44. A fourth photocell 79 is mounted in proximity to the boundary of the discharge conveyor section 56 located closest to the turntable 24. The fourth photocell 79 has a line of sight approximately orthogonal to the longitudinal centerline 58 of the conveyor 38 for producing a fourth control signal indicative of the presence of the load 44 between the discharge conveyor section 56 and the turntable conveyor section 54. It should be understood that the signals provided by the photocells 71, 73, 77 and 79, which may be of any known infra red design, are processed by the microprocessor for initiating various conveyor actions and the control of the vertical translation of the carriage when spiral wrapping is used in accordance with known techniques. The turntable is rotatably supported by a plurality of wheels 53 disposed near its periphery which are joined to the base 41 by vertically projecting frames 55. A turntable locking mechanism 57, which is described in detail in FIGS. 7 and 8, is attached to the base 41 from locking the frame in its home position where activation of the clamp 22, cutter 36, gathering mechanism 40 and arm 42 occur. The activation of the turntable locking mechanism is powered by an air cylinder and is described in detail infra with respect to FIGS. 7 and 8. A turntable conveyor drive mechanism 59 is provided for selectively moving loads 44 along the longitudinal axis 58 of the turntable conveyor section and stopping the load at the centerline 111. The details of the turntable conveyor drive 59 are discussed infra with regard to FIGS. 4 and 5.

The gathering mechanism 40 has a rotatable member 80 which is pivotably attached to a vertical member 82 which is joined to the base 41. An air cylinder 84, which is joined to the base 41, has an extensible member 86 that is controlled by the controller to be described infra. The extensible member 86 moves from a retracted position to an extended position upon the application of compressed air under the control of the controller. The extensible member 86 is pivotably attached to the rotatable member 80 to permit the gathering mechanism 40 to assume a vertical retracted position and an extended horizontal position.

The pivotable arm 42 has a pair of frames 90 which are joined to a pair of vertical stanchions 92 at a first pair of pivot points 94. Each frame 90 has an upright member 96 which is joined to a pair of horizontal members 98 joined respectively to the top and bottom ends of the upright member. A second pair of pivot points 100 joins the horizontal members 98 to a third frame 102 which has the brush 45 vertically mounted therein and an idler roller 104 for engaging the full width of the wrapping material 14 during rotation of the arm 42 to its extended position. Preferably the brush 45 is spring loaded to bias the wrapping material 14 against the load 44. The third frame 102 has upper and lower parallel horizontal members 106 which are joined to the pivot points 100 to form a parallelogram linkage for keeping the third frame 102 in an orientation substantially parallel to the longitudinal centerline 58 during rotation from its retracted position to its wrapping material engaging orientation (illustrated in phanton in FIG. 1). The function of the arm 42 is to force the film into a vertical plane where the jaws 32 of the clamp 22 grip the gathered material 28 and to cause the trailing end of the severed wrapping material to adhere to the underlying layer of wrapping material across the full width of the wrapping material. An air cylinder 108, which is joined to the base 41 at one end has an extensible member 110 that rotates the arm 42 from its retracted position to its wrapping material engaging extended position under the control of controller described infra.

The clamp 22 and the cutter 36 are mounted in proximity to the end 65 of the turntable 24 adjacent to the infeed conveyor section 52. The clamp 24 and cutter 36 are displaced as far as possible from the centerline 111 to provide the shortest possible length of wrapping material 14 extending from the point of clamping of the leading edge to the point of first contact with the load 44 during initiation of wrapping when the turntable is rotated counterclockwise. When stretch wrapping is performed with the wrapping material 14 under elastic deformation, the minimizing of the length of material between the point of clamping in the clamp 22 and the point of first contact with the load 44 minimizes or eliminates the "tail" of the leading edge of the wrapping material which protrudes from the wrapped load 44. As has been discussed supra, "tails" can interfere with mechanized handlng of stacked wrapped loads 44 by capture of a tail of a load under adjacent loads.

Figure 4:
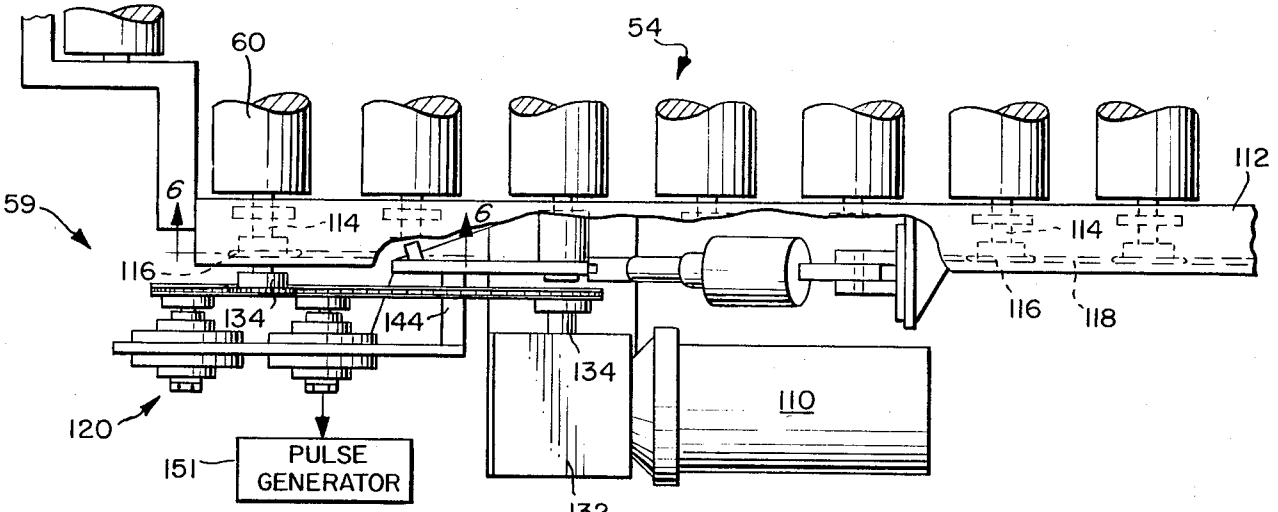
FIG. 4 is a plan view of the drive mechanism for the turntable conveyor section of the present invention.
Figure 5:
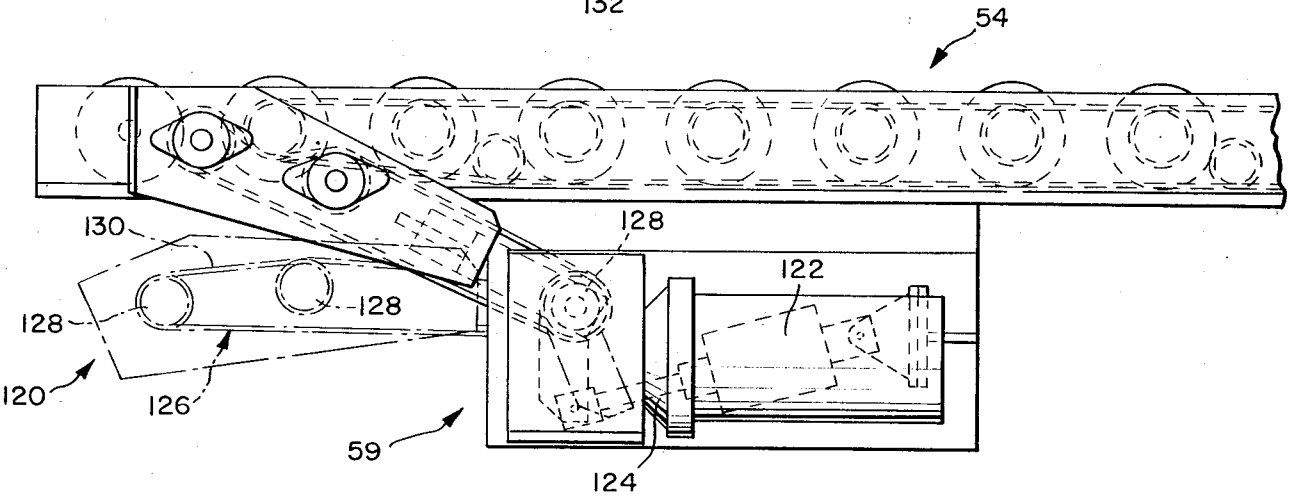
FIG. 5 is an elevational view of the drive mechanism for the turntable conveyor section.

FIGS. 4 and 5 illustrate the turntable conveyor drive section 59 in detail. The turntable has a plurality of driven rollers 60 which are journaled in parallel frame sections 112 of the turntable 24. Each of the driven rollers has a shaft 114 which extends axially outward from the point of journaling in the frame 112. A sprocket wheel 116 is joined to each of the shafts 114 which is driven by a chain 118 forming an endless loop with each of the sprockets. Rotation of the chain 118 causes each of the sprockets to move in unison. The drive 120 of the rollers 60 is pivotable between a retracted lower position and an extended upper position. The pivoting of the drive 120 is caused by an air cylinder 122 which has an extensible member 124 which pivots a chain drive unit 126 between a lower position and an upper position. The chain drive unit 126 is driven by motor 110. The chain drive unit 126 has three sprockets 128 which engage chain 130. A transmission 132 converts the rotary motion of the motor 110 into rotation of drive shaft 134 which drives one of the sprockets 128 and causes the other two remaining sprockets 128 to rotate in unison therewith as a consequence of the engagement of all three sprockets with the chain 130. In its upper position, the chain drive unit 120 engages sprocket 134 which is attached to an extension of shaft 114 which is farthest to the left in FIG. 4. The engagement of sprocket 134 by the chain 130 transfers rotary motion which is produced by the motor 110 into rotary motion of the rollers 60.

Figure 6:
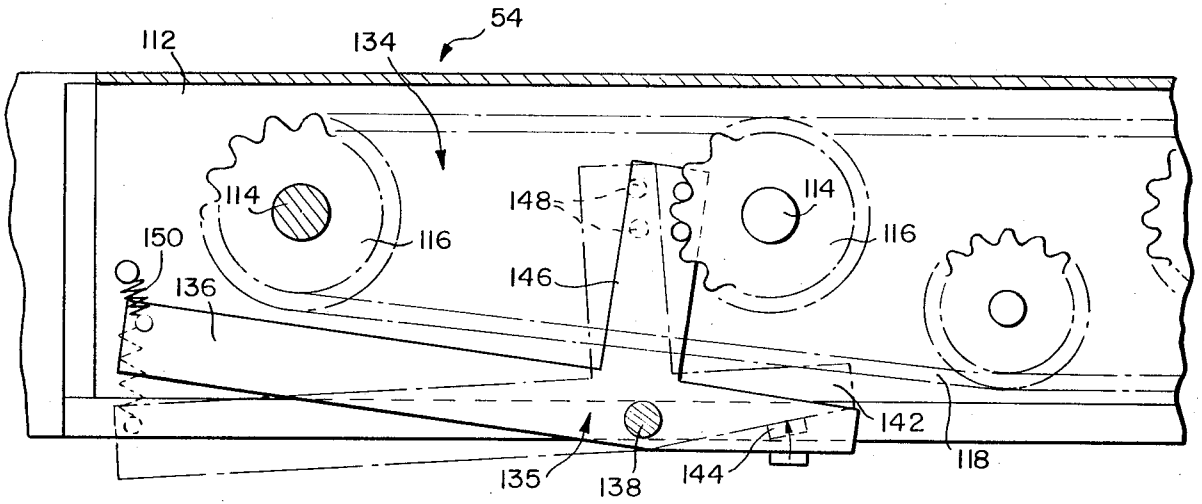
FIG. 6 is a fragmentary view of the locking mechanism for the turntable conveyor section.

FIG. 6 illustrates the turntable conveyor section locking mechanism 135 which functions to automatically lock the rollers 60 against rotation when the chain drive 126 is not engaging the sprocket 134. The roller locking mechanism 135 is pivotably joined to the underside of the frame member 112 at point 138. The roller locking mechanism 135 has a first part 136 which extends to the left of the pivot point 138 and a second part 142 which extends to the right of the pivot point. A orthagonal projection 144 extends outwardly from the frame 112 (FIG. 4) to a position where it engages the housing of the chain drive 126 when it is pivoted into its upward position such that the locking mechanism 135 will be rotated clockwise. The locking mechanism 135 has a projection 146 which extends orthogonal to the first and second sections 136 and 142 respectively. The projection 146 has a pair of pins 148 which are spaced apart a distance such that they extend into the valleys of the sprocket 116 to lock the sprocket wheel from rotation. The locking of the sprocket 116 against rotation prevents the remaining sprockets from being driven as a consequence of the unitary chain drive 118 of all of the sprocket wheels. A stretched spring 150 is mounted between the end 136 of the locking mechanism 135 and the frame 112 to cause the locking mechanism to assume its full clockwise position when the orthogonal projection 144 is not engaging the housing of the chain drive 126. Thus, the rotation of the chain drive 126 to its downward position under the control of the controller discussed infra automatically locks the rollers against rotation as a consequence of the clockwise rotation caused by the spring 150 which rotates the pins 148 into the valleys of the sprocket 116.

FIGS. 7 and 8 illustrate the table locking mechanism 57 for insuring that the turntable 24 is in a fixed home rotational position during the activation of various steps of the automatic stretch wrapping process by the microprocessor controller. A pair of downward projections 160 are attached to the underside of the turntable 24. These projections 160 are spaced apart and have inwardly beveled surfaces 162 which are used to guide a rotatable element 164 of the table locking mechanism 57 into secure engagement with the downward projections 162 when there is a slight misalignment between the projections and the rotatable element. The rotatable element 164 is mounted in an arm 166 which is journaled in a frame 168 which is attached to base 41. An air cylinder 170 having an extensible member 172 is secured to the arm 166. Extension of the extensible member 172 pivots the rotatable element 164 from a retracted position in which it does not engage the downward projections 160 to a position where it engages the downward projections and locks the turntable 24 securely in place. The pivoting of the rotatable element 164 into the table locking position is under the control of the microprocessor controller. The activation of the air cylinder 170 to rotate the rotatable element 164 to its extended position is only initiated when the microprocessor receives a continuous signal from the stop switch (not illustrated) which indicates the turntable 24 has stopped moving. The stop switch is disposed on the underside of the turntable 24. A flat surface is provided on the bottom of the turntable 24 for holding the stop switch closed when the turntable has stopped in proximity to the home position.

Figures 9, 10:
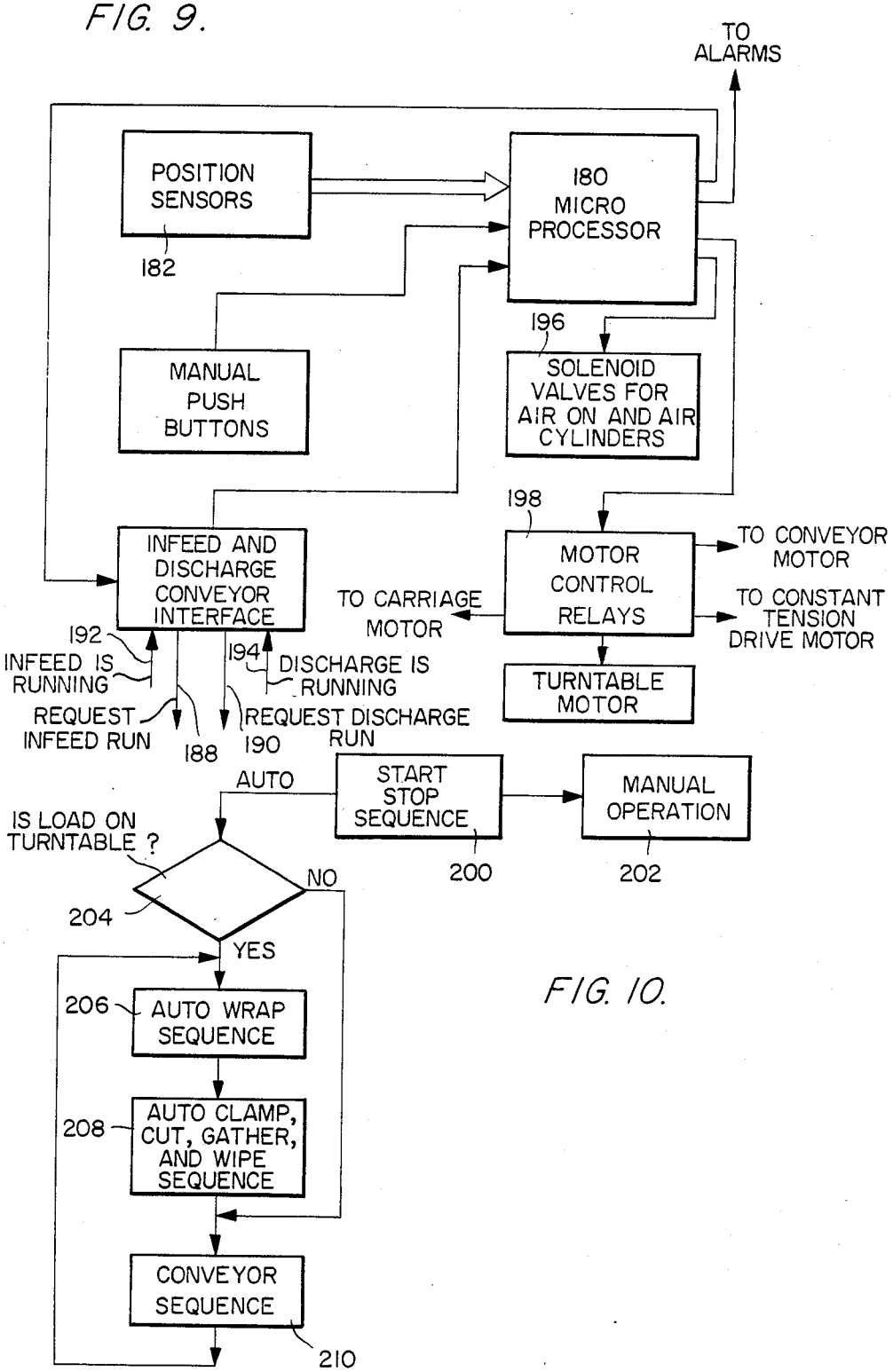
FIG. 9 is an electrical schematic of the present invention.
FIG. 10 is a flow chart of the microprocessor control program which is used for controlling the operation of the present invention.
Figure 11:
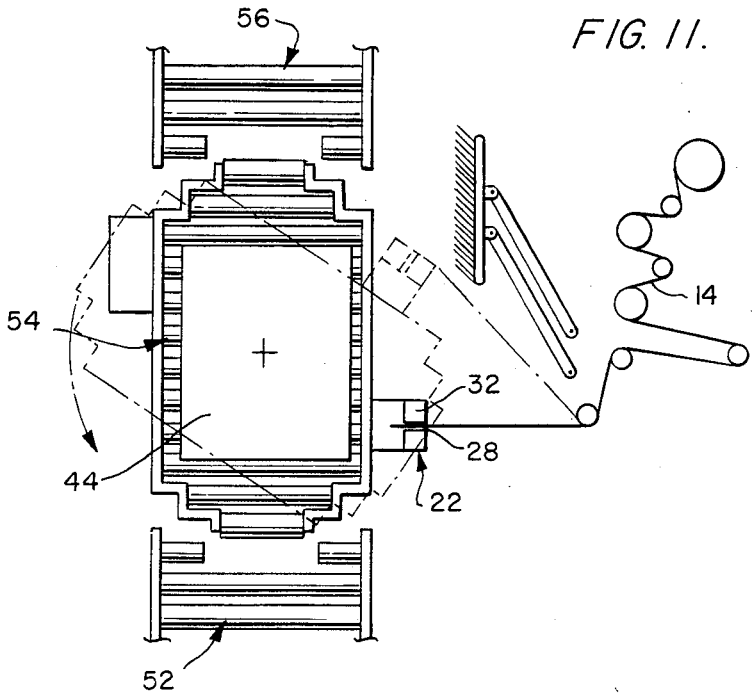
FIGS. 11–14 illustrate the operational sequence of automatically wrapping a load with stretch wrapping material in accordance with the present invention.

FIG. 9 illustrates an electrical schematic of the control system of the present invention. A microprocessor 180 controls the overall operation of the system in accordance with a stored program which is described in detail with reference to FIG. 10. A plurality of position sensors 182 are coupled to the microprocessor for providing position information necessary for operating the various power driven parts of the system. The sensors are provided on the turntable 24, the constant tension drive unit and carriage 18, the drive unit 59 for the turntable conveyor 54, the clamp 22, the arm 42, the gathering mechanism 40, and the cutter 36. The photocells 71, 73, 77 and 79 also function as position sensors. A push-button panel 184 is connected to the microprocessor. The push-button panel 184 contains push-buttons for activating each of the controls described above with regard to the position sensors 182 except for the photocells. Additionally, buttons are provided for selecting automatic and manual operation and an emergency stop for stopping the operation of the system immediately upon depressing of the emergency stop button. An infeed and discharge conveyor interface 186 is coupled to the microprocessor 180 to provide information of system operation and receives various control signals from the microprocessor. A first output 188 transmits a request of an infeed run which is generated by the microprocessor to request activation of the infeed conveyor section 52. A second output 190 is provided for transmitting a request discharge run which is generated by the microprocessor to request activation of the discharge conveyor section 56. An infeed running signal is transmitted to the infeed and discharge conveyor interface 186 by line 192 which is coupled to the infeed conveyor section 52 to signal that the infeed conveyor section is running. A discharge run signal is transmitted to the infeed and discharge conveyor interface 186 by the line 194 when the discharge conveyor section 56 is running. The microprocessor 180 is coupled to a plurality of solenoid valves 196 for controlling the turning on of the main supply of air and the various air cylinders which have been described above with reference to the system. These cylinders control the clamp 22, the cutter 36, the conveyor drive unit 120, the table locking mechanism 57, the gathering mechanism 40 and the arm 42. The microprocessor 180 is connected to a plurality of motor control relays 198 which respectively control the motor for translating the vertical carriage described above with reference to block 18, the turntable motor 25, the conveyor motor 110 and the motor for driving the constant tension drive unit which is described above with reference to block 18. The microprocessor is also coupled to a plurality of alarms which are preferably a display panel of condition lights. It should be understood that the perferred form of microprocessor controller is a programmed ICM Bear Bones Programmable Controller manufactured by Divelbiss Corporation of 9776 Mount Gilead Road, Fredericktown, Ohio 43019. The microprocessor sequences through a plurality of steps which are described above with reference to FIG. 10 to control the various sequences of events which are necessary for operating the system. If the conditions for completion of an individual task are not extant, the program cycles to the next task and thereafter repeatedly returns to the individual task and completes it when the necessary conditions are extant.

While the preferred form of controller is a programmed microprocessor, it should be understood that the invention is not limited thereto. Alternatively, the controller may be based upon relay logic, fluidics or discrete digital logic programmed specifically for operating the present invention.

FIG. 10 illustrates a flow chart of the preferred form of microprocessor control program for controlling the operation of the present invention. The program starts at starting point 200 which is the initiation of the start and stop sequence. The selection of either manual or automatic operation is made by the depressing of the appropriate automatic or manual button located in the manual push-buttons 184 described above with reference to FIG. 9. If manual operation is selected, the program branches to point 202 where the microprocessor causes the activation of the appropriate operation which is specified by depressing one of the manual push-buttons 184. If automatic operation is selected, the program branches from point 200 to decision point 204 where a decision is made if a load is located on the turntable. The detection of a load on the turntable is made by monitoring the photocell 77 to determine if its line of sight is intercepting a load. If the answer is "yes" at point 204 that a load 44 is disposed on the turntable 24, the program branches to block 206 where the automatic wrap sequence is conducted. At block 206 the microprocessor causes the activation of the turntable to wrap a load 44 with either a spiral or a wide web in accordance with known wrapping operations such as those performed by the assignee's spiral wrapping machines Model 8200 SA or UTS or the assignee's wide web wrapping machines Models 8200 SR or DR. The controlling of an automatic stretch wrapping machine to wrap a spiral or a wide web wrap around a load with a microprocessor based controller does not form part of the present invention. The assignee has previously marketed microprocessor based controller systems for spiral and wide web wrapping machines. At point 206, the load 44 is caused to be wrapped by the stretched wrapping material which has been gathered and held in the clamp 22. The load is either wrapped with a spiral wrap or a wide web to complete the covering of the load with the wrapping material to unitize the load. The turntable is stopped in its home position by the activation of the table locking mechanism 57 described above with reference to FIGS. 7 and 8.

The microprocessor 180 is specifically programmed to automatically center the load 44 on the centerline 111 of the turntable conveyor section 54. The photocells 71, 73, 77 and 79 produce output signals indicative of the presence of a load at various parts of the infeed conveyor section 52, turntable conveyor section 54 and discharge conveyor section 56 for use in controlling the automatic centering of the load to be wrapped on the center of the turntable 24. The photocell 77 also controls the height of the wrap when spiral wrapping is used. The presence of a load 44 on the turntable 24 in condition for wrapping is determined by the reading of the output from the photocell 77. The output signal from the photocell 71 is processed by the microprocessor 180 to activate the drive unit 59 to cause the turntable conveyor section 54 to start to rotate the driven rollers 60. As the load proceeds along the infeed conveyor section 52, it extends into the infeed conveyor gap 62 where it is intercepted by the line of sight of photocell 73. The first interception of the load 44 by the photocell 73 causes the activation of the centering program stored in the microprocessor. During the centering program, the signal from the photocell 73 activates a counter within the microprocessor for counting pulses which are those produced by pulse generator 151 (FIG.

4). The counter counts the number of pulses produced between the passage of the leading and trailing edges of the load 44 past the line of sight of photocell 73. After the passage of the trailing edge of the load 44 past the line of sight of the photocell 73, the counter counts double the number of pulses produced by the pulse generator 151 which are necessary to reach a total count of C wherein C is a constant equal to the number of pulses (each pulse is equal to a unit length of measurement) produced by the pulse generator 151 and the doubler during the passage of a load 44 from the line of sight of the photocell 73 to the centerline 111 of the turntable 24. When the counter reaches the count C, the microprocessor stops the motor 110 of the turntable conveyor section 54 which causes the load 44 to be stopped in a position which is centered longitudinally along the longitudinal axis 58 about the centerline 111. The program proceeds from block 206 to block 208 where the automatic clamp 22, arm 42, gathering mechanism 40 and cutter 36 sequence is completed. The initial condition for the processing at block 208 is that the turntable is locked in its home position by the activation of the table locking mechanism 57. The usage of wrapping material 28 is minimized because of the effective clamping of the gathered wrapping material 28 in clamp 22 from the very beginning of the initiation of the automatic wrapping sequence described above with reference to block 206 which permits the application of full tension from initiation of wrapping. The release of gathered wrapping material 28 from the clamp 22 allows the leading edge of the tail to pull toward or completely back underneath the overlying wraps because of the "rubberband" effect of releasing an end of an elastically stretched material. The location of the clamp 22 and cutter 36 in proximity to one end of the turntable which is located closest to the side of the turntable where the wrapping material first contacts the load during the initiation of wrapping minimizes the length of the wrapping material which is exposed and which contracts upon release by the clamp 22. The minimizing of the exposed section minimizes or eliminates the presence of a tail. The microprocessor activates the pivotable arm 42 to cause its movement from its retracted position to its extended position which causes the wrapping material 14 to be deflected into the vertical plane which intercepts the opening of the clamp jaws 32 and the cutter jaws 38. After the microprocessor senses that the pivotable arm 42 is fully extended, the gathering mechanism 40 is activated to cause it to pivot from its retracted vertical position to its extended horizontal position which forces the edge of the wrapping material 14 downward to reduce the width (gather) of the wrapping material into engagement with the clamp jaws 32 which have been previously opened under the control of the microprocessor to release the leading edge of the wrapping material. Once the microprocessor senses that the gathering mechanism 40 is in its fully extended horizontal position, the clamp mechanism 22 is activated to close the clamp jaws 32 to securely clamp the gathered wrapping material 28. Once the microprocessor senses that the clamp 22 has closed, the cutter 36 is activated to shear wrapping material 14 to release the trailing end from the supply of wrapping material and to permit the brush 45 to force the full width of the severed trailing end against the load 44 where the natural cling of the wrapping material causes the trailing end to adhere to the underlying wrap of wrapping material. The program proceeds from block 208 to block 210 where the conveyor sequence is executed. At the conveyor sequence 210, the microprocessor activates the turntable conveyor section 54 to transport the wrapped load 44 from the turntable 24 while the brush 45 forces the trailing edge of the wrapping material against the load 44. The pivotable arm 42 is retracted once the photocell 77 senses the departure of the load 44. The discharge conveyor section 56 is activated by the microprocessor at the same time that the turntable conveyor section 54 is activated if conditions on the discharge do not preclude activation. Successive loads are processed in the previously described manner in a fully automatic mode by branching back to the autowrap sequence 206. If the decision was "no" at decision point 204 that a load was not located on the turntable, the program branches directly from decision point 204 to conveyor sequence 210.

Figure 12:
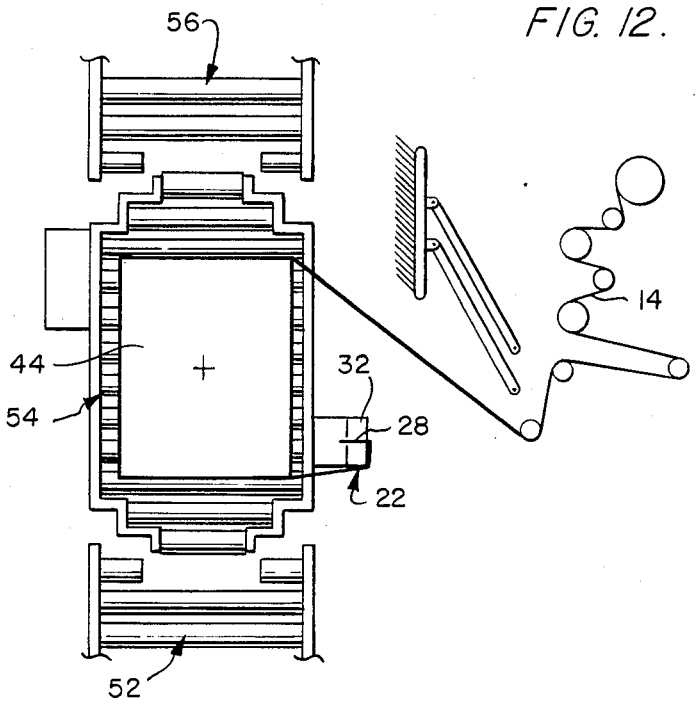
Figure 13:
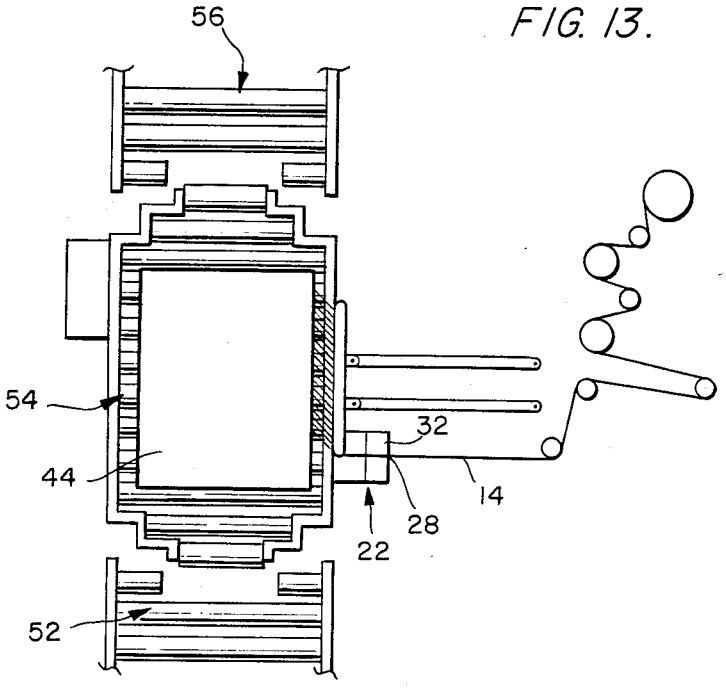
Figure 14:
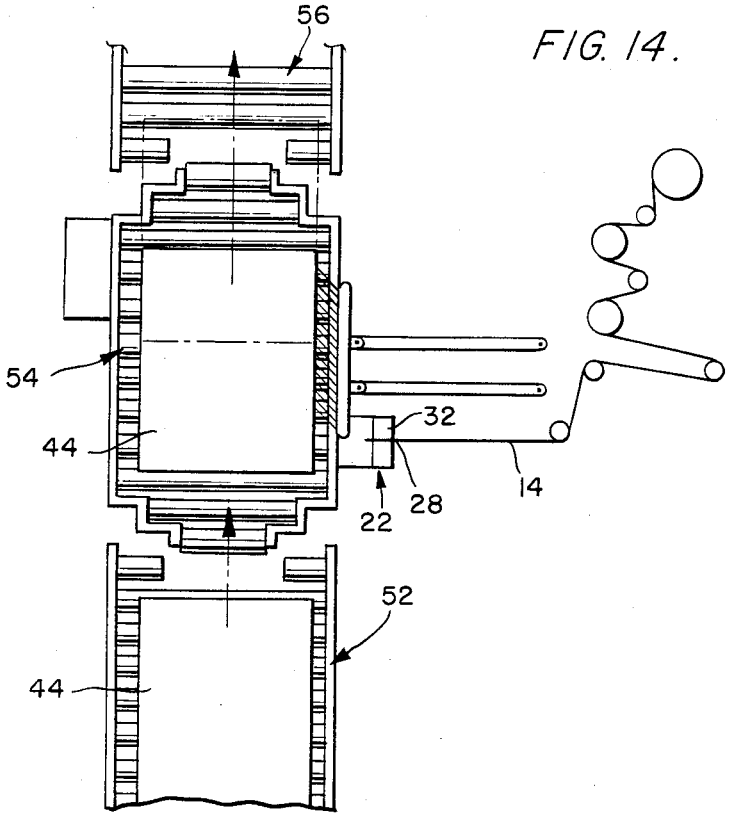

FIGS. 11 through 14 illustrate the sequence of events which occur during automatic wrapping of a load 44 beginning with the location of the load on the turntable 24. Initially with reference to FIG. 11, the gathered wrapping material 28 is held securely in the jaws 32 of the clamp 22. On account of the secure clamping of the gathered wrapping material 28 in the jaws 32 of the clamp 22, full wrapping tension is applied to the wrapping material 14 from the very beginning of initiation of the wrapping cycle to minimize the amount of wrapping material being used. The turntable is rotated counterclockwise with reference to FIG. 11. As is apparent from visualization of the wrapping sequence as indicated in phantom in FIG. 11, the location of the clamp 22 on one end of the turntable 24 which is located closest to the point of first contact of the wrapping material 14 with the load 44 minimizes the length of wrapping material extending between the point of clamping of the gathered wrapping material 28 and the contact with the first corner of the load 44 and minimizes the length of a tail which retracts upon opening of the clamp at the block 208. The wrapping sequence continues as illustrated in FIG. 12 in which ultimately a plurality of turns of wrapping material 14 are wrapped around the load 44. The turntable 24 is locked in its home position as illustrated in FIG. 13 by activation of the locking mechanism 57. The jaws 32 of the clamp 22 release the leading edge of the tail of gathered wrapping material 28. The elasticity of the gathered wrapping material causes the leading edge to pull back toward the point of first contact with the load 44 to minimize or eliminate the tail. The pivotable arm 42 is pivoted to its extended position where the brush 45 forces the full width of the wrapping material 14 against the side of the load 44 and into the plane of the clamp 22 and the cutter 36. The gathering mechanism 40 (not illustrated) forces the wrapping material into engagement with the jaws 32 of clamp 22 which then reclamps the wrapping material. The gathered wrapping material 28 is thereafter severed by the cutter 36. The pivotable arm 42 assumes its fully-extended position until the load 44 is transported off of the turntable 24. FIG. 14 illustrates the transportation of the wrapped load 44 from the turntable 24 during which the brush 45 forces the severed trailing end of the wrapping material 14 to spread out to its full width to maximize the cling of the trailing edge to the underlying wrap of wrapping material.

While the invention has been described with reference to its preferred embodiment, it should be understood that numerous modifications may be made thereto without departing from its spirit and scope as defined by the appended claims. It is intended that all such modifications fall within the appended claims.

I claim:

1. An automatic wrapping machine comprising:

(a) a turntable having a surface for rotatably supporting a load to be wrapped with a wrapping material;

(b) means for providing wrapping material of a given width to be used to wrap a load disposed on the turntable, the load being wrapped with a section of wrapping material which is defined by a leading edge and a trailing edge;

(c) means for rotating the turntable to cause wrapping of the load with the wrapping material under tension during wrapping;

(d) means for gathering the wrapping material into a reduced width relative said given width comprising a means for engaging the edge of said material;

(e) clamping means mounted for rotation with the turntable for clamping a gathered leading edge of the wrapping material during initiation of wrapping of the load to cause the wrapping material to be wrapped around the load without slippage as it rotates with the turntable and for clamping gathered wrapping material at a conclusion of wrapping the load which becomes the gathered leading edge for wrapping the next load, the clamping means being disposed below the wrapping material at all times during wrapping of the load, except when the means for gathering has gathered the wrapping material and having means to open and close said clamping means;

(f) means for moving said material engaging means in a path aligned with the clamping means to move said material into the open clamping means at the end of the wrapping operation;

(g) cutting means carried by the turntable disposed between the surface of the turntable and the clamping means for severing the gathered wrapping material clamped by the clamping means at the conclusion of wrapping to form the trailing edge;

(h) means, separate from said gathering means, for attaching the portion of the wrapping material located between the load and the wrapping material providing means and the trailing edge to an underlying wrap of wrapping material with a width of contact with the underlying wrapping material being substantially equal to the given width and for aligning the material with the material engaging means; and (i) means for controlling the operation of the wrapping machine to cause in the following sequence:

(i) the clamping means to clamp the gathered leading edge of the wrapping material gathered during the previous wrapping operation at the initiation of wrapping of a load to hole the wrapping material under tension to maintain stretch in the wrapping material and to release the clamped gathered leading edge of wrapping material at a time before the activation of the means for gathering to allowed the gathered wrapping material to assume a non-stretched condition;

(ii) the means for attaching to be activated to attach the said portion of the wrapping material to an underlying layer of wrapping material along its full width before the activation of the gathering means;

(iii) the means for gathering to be activated after the release of the gathered leading edge of the wrapping material from the clamping means to reduce the width of the wrapping material and move the material engaging means in its path so that it pushes the material into the open clamping means;

(iv) the clamping means to be reactivated after the wrapping material is gathered in the open clamping means to clamp the gathered wrapping material in proximity to the trailing edge of the material; and (v) the cutting means to be activated to sever the clamped gathered material to sever the trailing edge from the clamped wrapping material whereby the clamping means holds the leading edge for the next load to be wrapped and the means for attaching attaches the trailing edge to the wrapped load.

2. An automatic wrapping machine in accordance with claim 1 wherein:

(a) the means for attaching the trailing edge comprises an arm which has a retracted position that does not engage the wrapping material and an extended position that engages the wrapping material which aligns the wrapping material with the means for gathering and in a plane in which the clamping means clamps the wrapping material; and wherein (b) the means for controlling causes the arm to extend after the clamping means releases the gathered wrapping material which was clamped during the initiation of wrapping.

3. An automatic wrapping machine in accordance with claim 2, wherein the arm is pivotable between its retracted and extended positions and further comprises a brush which engages the wrapping material across its width to force the wrapping material against the load when the arm is in its extended position whereby the wrapping material is caused to contact an underlying layer of wrapping material across its full width.

4. An automatic wrapping machine in accordance with claim 1, further comprising:

(a) a conveyor with a longitudinal axis for moving loads along its longitudinal axis, the conveyor having an infeed section which is located upstream of the turntable, a turntable conveyor section; and a discharge section located downstream of the turntable; and wherein (b) the means for controlling selectively activates the infeed conveyor section to move a load to be wrapped from the infeed section onto the turntable to a position on the turntable where the load is to be wrapped and after completion of wrapping moves the load from the position where the load was wrapped on the turntable to the discharge conveyor section, where the load is moved along the longitudinal axis away from the turntable.

5. An automatic wrapping machine in accordance with claim 4, wherein the means for controlling includes means for centering loads on the turntable along the longitudinal axis.

6. An automatic wrapping machine in accordance with claim 5, wherein (a) an infeed-turntable gap is disposed between the infeed conveyor section and the turntable conveyor section and a turntable-discharge gap is disposed between the turntable conveyor section and the discharge conveyor section;

(b) a first photocell is disposed in proximity to an end of the infeed conveyor section located closest to the turntable, the first photocell having a line of sight transverse to the longitudinal axis of the conveyor and pointed in a direction angling away from the turntable for producing a first control signal for detecting the presence of a load to be wrapped on the infeed conveyor section;

(c) a second photocell is disposed in proximity to the infeed-turntable gap, the second photocell having a line of sight extending approximately orthogonal to the longitudinal axis of the conveyor across the infeed turntable gap for producing a second control signal for detecting the presence of a load between the infeed and turntable conveyor sections and the leading and trailing edges of a load to be wrapped;

(d) a third photocell having a line of sight transverse to the longitudinal axis and pointed in a direction angling toward the center of the turntable for producing a third control signal indicative of a load on the turntable;

(e) a fourth photocell is disposed in proximity to the turntable-discharge gap, the fourth photocell having a line of sight approximately orthogonal to the longitudinal axis of the conveyor for producing a fourth control signal indicative of the presence of a load between the discharge conveyor and turntable conveyor sections; and (f) the means for controlling is responsive to (1) the first control signal for initiating the movement of a load to be wrapped from the infeed conveyor section to the turntable; (2) the second control signal to indicate the leading and trailing edges of an object to be wrapped; (3) the third control signal for indicating the presence of a load on the turntable; and (4) the fourth signal for indicating that the load has cleared the turntable.

7. An automatic wrapping machine in accordance with claim 1, further comprising:

(a) means for stopping the turntable at a predetermined rotational position at the completion of wrapping; and wherein (b) the gathering means, the clamping means and the cutting means are all activated under the control of the means for controlling after the turntable is in its predetermined rotational position.

8. An automatic wrapping machine in accordance with claim 1, wherein the means for gathering comprises a pivotable element which has a retracted position which does not contact the wrapping material and an extended position in which the element engages the wrapping material in a plane which intersects the clamping means to cause the width of the wrapping material to be reduced and gathered and the gathered wrapping material to be forced into engagement with the clamping means.

9. An automatic wrapping machine in accordance with claim 8, wherein the pivotable element includes at least one rotatable element which engages an edge of the wrapping material as it is pivoted from its retracted position to its extended position for reducing the width of the wrapping material.

10. An automatic wrapping machine in accordance with claim 4, wherein the turntable conveyor section comprises:

(a) a plurality of rotatably mounted rollers having their axes of rotation disposed perpendicular to the longitudinal axis of the conveyor during operation of the turntable conveyor section;

(b) means for driving the rollers which is movable from a retracted position where it does not drive the rollers to an extended position in which the rollers are driven for causing longitudinal movement of a load on the turntable;

(c) means for locking the rollers against rotation when the means for driving the rollers is in its retracted position and for releasing the rollers when the means for driving the rollers is in its extended position; and (d) wherein the means for controlling causes the selective movement of the means for driving the rollers from its retracted position to its extended position during the infeed of a load onto the turntable, the centering of the load on the turntable, and the discharge of the load from the turntable.

11. An automatic wrapping machine in accordance with claim 10, wherein (a) the turntable conveyor section has first and second ends which are respectively located in proximity to the infeed and discharge conveyors sections, at least one idler roller being located at each of the first and second ends, each idler roller having two ends and being disposed such that its ends are equidistant from a longitudinal centerline of the conveyor and the length of each idler roller being less than the length of the driven rollers;

(b) the infeed and the discharge conveyor sections each have at least one pair of idler rollers having a common axis of rotation, the pair of idler rollers of the infeed conveyor section being disposed in proximity to one end of the turntable conveyor section and the pair of idler rollers of the discharge conveyor section being disposed in proximity to the other end of the turntable conveyor section, a gap being disposed between each pair of idler rollers which intersects the longitudinal centerline of the conveyor whereby the turntable may rotate without interference with the infeed and discharge conveyor sections while the longitudinal displacement between the turntable conveyor section and the infeed and discharge sections is minimized.

12. An automatic wrapping machine in accordance with claim 1, wherein the wrapping material is stretchable and is prestretched before delivery to the turntable for wrapping a load.

13. An automatic wrapping machine in accordance with claim 12, wherein the wrapping material is delivered to the turntable for wrapping a load under constant tension.

14. An automatic wrapping machine in accordance with claim 1, wherein the clamping means is disposed below the wrapping surface during wrapping so that the wrapping material does not engage the clamping means during wrapping of a load except at the point of clamping of the wrapping material.

15. An automatic wrapping machine in accordance with claim 2, further comprising:

(a) means for stopping rotation of the turntable at a predetermined home position after wrapping of a load is completed but prior to release of the wrapping material held in the clamp at the initiation of wrapping;

(b) the turntable has a longitudinal axis and first and second ends which ends are opposed to each other and which are intersected by the longitudinal axis; and wherein (c) the gathering means, the clamping means and the cutting means are all activated under the control of the means for controlling after the turntable has stopped at its home position;

(d) each wrapped load has a leading edge of wrapping material which is the wrapping material clamped by the clamping means at the initiation of wrapping and is wrapped under tension which elastically elongates the wrapping material extending from a clamped leading edge to the point of first engagement with the load; and (e) the clamping and cutting means are mounted on the turntable in proximity to one of the ends of the turntable and the turntable is rotated in a direction of rotation such that the length of the elastically elongated wrapping material extending between the clamping means and the point of first engagement with the load is shorter than if the clamping means was mounted at the center of the turntable with respect to the longitudinal axis of the conveyor whereby upon release by the clamping means of the leading edge is drawn toward the load to reduce any loose section of the leading edge.

16. An automatic wrapping machine in accordance with claim 6, wherein the means of centering includes:

(a) means for producing pulses indicative of the motion of the turntable conveyor section along its longitudinal axis, one pulse being produced per unit distance of motion of a load along the longitudinal axis of the turntable;

(b) means for doubling the frequency of the pulses produced by the means for producing;

(c) means for counting, responsive to the means for producing pulses and to the means for doubling for counting a total of C pulses beginning from the passage of a leading edge of a load past the line of sight of the second photocell, the means for counting functioning to count the number of pulses produced by the means for doubling during the passage of the leading and trailing edges of a load to be wrapped past the line of sight of the second photocell and after passage of the trailing edge of the load past the line of sight of the second photocell functioning to count the pulses produced by the means for producing until the total count is equal to C wherein C is a constant which is equal to the number of pulses produced by the means for producing for a load to move from the line of a reference point to the center of the turntable along the longitudinal axis at the home position; and (d) means for stopping the activation of the infeed conveyor section when the count of the means for counting is equal to C.

17. A machine in accordance with claim 1, wherein the means for attaching further comprises:

(a) an arm which has a retracted position that does not engage the wrapping material and an extended position that engages the wrapping material which aligns the wrapping material with the means for gathering in a plane and in which the clamping means clamps the wrapping material, the arm carrying a brush which engages the wrapping material across its width to force the wrapping material against the load when the arm is in its extended position to cause the wrapping material to contact an underlying layer of wrapping material cross substantially its full width.

18. An automatic wrapping machine comprising:

(a) a turntable having a surface for rotatably supporting a load to be wrapped with a wrapping material;

(b) means for providing wrapping material of a given width to be used to wrap a load disposed on the turntable, the load being wrapped with a section of wrapping material which is defined by a leading edge and a trailing edge;

(c) means for rotating the turntable to cause wrapping of the load with the wrapping material under tension during wrapping;

(d) means for gathering the wrapping material into a reduced width relative said given width comprising a means for engaging the edge of said material;

(e) clamping means mounted for rotation with the turntable for clamping a gathered leading edge of the wrapping material during initiation of wrapping of the load to cause the wrapping material to be wrapped around the load without slippage as it rotates with the turntable and for clamping gathered wrapping material at a conclusion of wrapping the load which becomes the gathered leading edge for wrapping the next load, the clamping means being disposed below the wrapping material at all times during wrapping of the load, except when the means for gathering has gathered the wrapping material and having means to open and close said clamping means;

(f) means for moving said material engaging means in a path aligned with the clamping means to move said material into the open clamping means at the end of the wrapping operation;

(g) cutting means carried by the turntable disposed between the surface of the turntable and the clamping means for severing the gathered wrapping material clamped by the clamping means at the conculsion of wrapping to form a trailing edge;

(h) means for stopping the rotation of the turntable at the completion of wrapping;

(i) means, separate from said gathering means, for attaching the portion of the wrapping material located between the load and the wrapping material providing means and the trailing edge to an underlying wrap of wrapping material with a width of contact with the underlying wrapping material being substantially equal to the given width and for aligning the material with the material engaging means; and (j) means for controlling the operation of the wrapping machine to cause in the following sequence:

(i) the clamping means to clamp the gathered leading edge of the wrapping material at the initiation of wrapping of a load to hold the wrapping material under tension to maintain stretch in the wrapping material;

(ii) the means for stopping to stop the rotation of the turntable at the completion of wrapping of the load;

(iii) the clamping means to be activated to release the clamped gathered leasing edge of the wrapping material after the completion of wrapping of the load to allow the gathered wrapping material to assume a non-stretched condition;

(iv) the means for attaching to be activated to attach the said portion of the wrapping material to an underlying layer of wrapping material along its full width before the activation of the gathering means;

(v) the means for gathering to be activated after the release of the gathered leading edge of the wrapping material from the clamping means to reduce the width of the wrapping material and move the material engaging means in its path so that it pushes the material into the open clamping means;

(vi) the clamping means to reactivated after the wrapping material is gathered in the open clamping means to clamp the gathered wrapping material in proximity to the trailing edge of the material; and (vii) the cutting means to be activated to sever the clamped gathered material to sever the trailing edge from the clamped wrapped material whereby the clamping means holds the leading edge for the next load to be wrapped and the means for attaching attaches the trailing edge to the wrapped load.

19. An automatic wrapping machine in accordance with claim 18, wherein the means for stopping causes the turntable to stop at a fixed location at the completion of wrapping.

20. An automatic wrapping machine in accordance with claim 19, wherein the means for gathering comprises a pivotable element which has a retracted position which does not contact the wrapping material and an extended position in which the pivotable element engages the wrapping material in a plane which intersects the clamping means to cause the width of the wrapping material to be reduced and gathered and the gathered wrapping material to be forced into engagement with the clamping means.

21. An automatic wrapping machine in accordance with claim 20, wherein the pivotable element includes at least one rotatable idler element which engages an edge of the wrapping material as it is pivoted from its retracted position to its extended position to reduce the width of the wrapping material.

22. An automatic wrapping machine in accordance with claim 19, wherein the clamping means is disposed below the wrapping surface during wrapping so that the wrapping material does not engage the clamping means during wrapping of a load except at the point of clamping.

23. An automatic wrapping machine in accordance with claim 20, wherein the clamping means is disposed below the wrapping surface during wrapping so that the wrapping material does not engage the clamping means during wrapping of a load except at the point of clamping.

24. An automatic wrapping machine in accordance with claim 18, wherein:

(a) the means for attaching the trailing edge comprises an arm which has a retracted position that the arm does not engage the wrapping material and an extended position that engages the wrapping material which aligns the wrapping material with the means for gathering and in a plane in which the clamping means clamps the wrapping material; and wherein (b) the means for controlling causes the arm to extend after the clamping means opens to release the gathered wrapping material which was clamped during the initiation of wrapping.

25. An automatic wrapping machine in accordance with claim 24, wherein the arm further comprises a brush which engages the wrapping material across its width to force the wrapping material against the load when the arm is in its extended position.

26. An automatic wrapping machine in accordance with claim 18, further comprising:

(a) a conveyor with a longitudinal axis for moving loads to be wrapped along its longitudinal axis, the conveyor having an infeed section which is located upstream of the turntable, a discharge section which is located downstream of the turntable and a turntable conveyor section; and wherein (b) the means for controlling selectively activates the infeed conveyor section to move a load to be wrapped from the infeed section onto the turntable, selectively activates the turntable conveyor section to move a load coming from the infeed section to a centered position on the turntable where the load is to be wrapped and from the position where the load was wrapped on the turntable to the discharge conveyor section where the load is moved along the longitudinal axis away from the turntable.

27. An automatic wrapping machine in accordance with claim 1, wherein (a) an infeed-turntable gap is disposed between the infeed conveyor section and the turntable conveyor section and a turntable-discharge gap is disposed between the turntable conveyor section and the discharge conveyor section;

(b) a first photocell is disposed in proximity to the boundary of the infeed conveyor section located closest to the turntable which has a line of sight transverse to the longitudinal axis of the conveyor and pointed in a direction angling away from the turntable for producing a first control signal for detecting the presence of a load to be wrapped on the infeed conveyor section;

(c) a second photocell is disposed in proximity to the infeed-turntable gap which has a line of sight extending approximately orthogonal to the longitudinal axis of the conveyor for producing a second control signal for detecting the presence of a load between the infeed and turntable conveyor sections and the leading and trailing edges of an object to be wrapped;

(d) a third photocell having a line of sight transverse to the longitudinal axis and pointed in a direction angling toward the turntable for producing a third control signal indicative of a load on the center of the turntable;

(e) a fourth photocell is disposed in proximity to the boundary of the discharge conveyor section located closest to the turntable which has a line of sight approximately orthogonal to the longitudinal axis of the conveyor for producing a fourth control signal indicative of the presence of the load between the discharge conveyor and turntable conveyor sections; and (f) the means for controlling is responsive to (1) the first control signal for initiating the movement of a load to be wrapped from the infeed conveyor section to the turntable; (2) the second control signal to indicate the leading and trailing edges of object to be wrapped; (3) the third signal for controlling the centering of the load to be wrapped on the turntable; and (4) the fourth signal for indicating that the load has cleared the turntable.

28. An automatic wrapping machine in accordance with claim 27, wherein the turntable conveyor section comprises:

(a) a plurality of rotatably mounted rollers having their axes of rotation disposed perpendicular to the longitudinal axis of the conveyor during operation of the turntable conveyor section;

(b) means for driving the rollers which is movable from a retracted position where it does not drive the rollers to an extended position in which the rollers are driven for causing the longitudinal movement of a load on the turntable;

(c) means for locking the rollers against rotation when the means for driving the rollers is in its retracted position and released when the means for driving the rollers is in its extended position; and (d) wherein the means for controlling causes the selective movement of the means for driving the rollers from its retracted position to its extended position during the infeed of a load onto the turntable, the centering of the load on the turntable, and the discharge of the load from the turntable.

29. An automatic wrapping machine in accordance with claim 28, wherein (a) the turntable conveyor has first and second ends which are respectively located in proximity to the infeed and discharge conveyors, at least one idler roller being located at each of the first and second ends, each idler roller having two ends and being disposed such that its ends are equidistant from a longitudinal centerline of the conveyor and the length of each idler roller being less than the length of the driven rollers;

(b) the infeed and the discharge conveyor sections each have at least one pair of idler rollers having a common axis of rotation, the pair of idler rollers of the infeed conveyor section being disposed in proximity to one end of the turntable conveyor section and the pair of idler rollers of the discharge conveyor section being disposed in proximity to another end of the turntable conveyor section, a gap being disposed between each pair of idler rollers which intersects the longitudinal centerline of the conveyor whereby the turntable may rotate without interference with the infeed and discharge conveyor sections while the longitudinal displacement between the rollers of the turntable and the infeed and discharge sections is minimized.

30. An automatic wrapping machine in accordance with claim 18, wherein the wrapping material is stretchable and is prestretched before delivery to the turntable for wrapping a load.

31. An automatic wrapping machine in accordance with claim 30, wherein the wrapping material is delivered to the turntable for wrapping a load under constant tension.

32. A wrapping machine in accordance with claim 18, wherein (a) the turntable has a longitudinal axis and first and second ends which are opposed to each other and which ends are intersected by the longitudinal axis;

(b) each wrapped load has a leading edge of wrapping material which is the wrapping material gripped by the clamping means at the initiation of wrapping and is wrapped under tension which elastically elongates the wrapping material extending from a clamped leading the edge to the point of first engagement with the load; and (c) the clamping and cutting means are mounted on the turntable in proximity to one of the ends of the turnatable and the turntable is rotated in a direction of rotation such that the length of the elastically elongated wrapping material extending between the clamping means and the point of first engagement with the load is shorter than if the clamp was mounted at the center of the turntable with respect to the longitudinal axis of the conveyor whereby upon release by the clamping means of the leading edge is drawn toward the load to reduce any loose section of the leading edge.

33. A machine in accordance with claim 18 wherein the means for attaching further comprises:

(a) an arm which has a retracted position that does not engage the wrapping material and an extended position that engages the wrapping material which aligns the wrapping material with the means for gathering in a plane and in which the clamping means clamps the wrapping material, the arm carrying a brush which engages the wrapping material across its width to force the wrapping material against the load when the arm is in its extended position to cause the wrapping material to contact an underlying layer of wrapping material across substantially its full width.

* * * * *